United States Patent [19]

Furlong

[11] Patent Number: 4,968,035

[45] Date of Patent: Nov. 6, 1990

[54] SLOT BALL GAME

[76] Inventor: Donald F. Furlong, 9300 Greenwood Rd., Grass Lake, Mich. 49240

[21] Appl. No.: 511,239

[22] Filed: Apr. 19, 1990

[51] Int. Cl.[5] ..... A63D 3/00

[52] U.S. Cl. ..... 273/125 R; 273/108; 273/118 R; 273/121 R; 273/122 R; 273/123 R

[58] Field of Search ..... 273/108, 109, 113, 115, 273/116, 118–125

[56] References Cited

U.S. PATENT DOCUMENTS

| | | | |
|---|---|---|---|
| 1,430,838 | 10/1922 | Olson . | |
| 1,757,870 | 5/1930 | Mahr . | |
| 2,147,526 | 2/1939 | Farmer | 273/118 |
| 4,790,535 | 12/1988 | Droske, Jr. | 273/118 |

*Primary Examiner*—Edward M. Coven
*Assistant Examiner*—Raleigh W. Chin
*Attorney, Agent, or Firm*—Beaman & Beaman

[57] ABSTRACT

A slot ball game wherein balls are rolled up a slightly inclined surface having at least one elongated slot formed therein defining a target having an opening of sufficient width and length to receive and "trap" a plurality of balls. The opening of the slot target automatically decreases in size as the balls are trapped therein which makes the game more difficult as the game progresses. Numbers may be provided adjacent the length of the slot target for scoring purposes, and a ball ejector may be incorporated with the game for selectively releasing the trapped balls.

12 Claims, 1 Drawing Sheet

SLOT BALL GAME

BACKGROUND OF THE INVENTION

Rolling ball games usually consist of a frame having a ball-rolling surface defined thereon upon which balls are rolled toward targets. Often, the ball-rolling surface is disposed between vertical walls to confine the balls on the surface. Typically, an individual target consists of either an opening or recess formed in the surface through which a ball is passed or received, or, a target may consist of a scoring zone defined between a pair of spaced members vertically extending from the surface.

To make such games challenging and interesting, obstacles are often mounted at various locations on the surface and the targets are arranged at predetermined locations requiring the players to bank the balls off the walls or obstacles in order to project the balls into the targets. However, while some of the targets may receive more than one ball, the targets do not decrease in size as the game progresses, and, if the targets automatically decreased in size as the balls were received therein, a new dimension would be added to such games to provide a greater challenge for the players.

It is an object of the invention to provide a game of the rolling ball type which incorporates at least one target adapted to trap a plurality of balls wherein the target automatically decreases in size to make the game more difficult as the balls are trapped therein.

Another object of the invention is to provide a slot ball game having a ball-rolling surface defined thereon upon which balls are rolled wherein at least one elongated slot is formed in the surface defining a slot target of sufficient length and width to "trap" a plurality of balls rolled thereover, and, as the balls are trapped in the slot target, the exposed area of the slot automatically decreases making the game more difficult for the players as the game progresses.

A further object of the invention is to provide a slot ball game in which balls are rolled up an elongated, slightly inclined surface from a ball launching end adjacent the front end of the game toward a target formed in an uppermost portion of the surface adapted to trap a plurality of balls rolled thereover wherein the game incorporates a ball ejector operable by a control lever disposed adjacent the front of the game for selectively releasing the trapped balls permitting the balls to roll back to the launching end.

Yet a further object of the invention is to provide a slot ball game wherein the game incorporates a high quality construction in the form of a decorative furniture piece suitable for living quarters.

In the practice of the invention the game includes a frame having a slightly inclined playing board including an upper side defining a ball-rolling surface disposed between a pair of spaced lateral side walls, a front wall, and a back wall. Each of the walls vertically extend from the ball-rolling surface to confine a ball rolled thereon. Preferably, the frame will be mounted upon its own legs to position the game at a convenient height for the player.

The lowermost portion of the ball-rolling surface adjacent the front wall defines a ball-launching end and the uppermost portion adjacent the back wall is provided with a slot opening defining a target adapted to "trap" a plurality of balls rolled thereinto. The slot target extends through the thickness of the playing board and includes a pair of non-parallel spaced edges which define the width of the slot target. The spaced edges extend from a front edge and terminate at a back edge and converge in the direction toward the back edge, and the front and back edge define the length of the slot target.

The edges of the slot target define an opening of sufficient width and length to receive a plurality of balls rolled thereover whereby each ball received in the slot target rests upon the spaced edges such that one portion of the ball extends above the surface while the another portion extends into the depth of the slot target to trap the ball therein. Due to the inclination of the playing board and the tapered configuration of the slot, each ball trapped in the slot target rolls downwardly into engagement with the front edge, or into engagement with a previously trapped ball. Thus, as each ball is trapped in the slot target, the balls accumulate along the length thereof and the area of the slot target for trapping a subsequently projected ball automatically decreases in size.

Preferably, a player will project a ball from the launching end toward the slot target by hand. The ball may be banked off the side walls or the back wall, and bumpers may be located adjacent the back wall to direct a ball toward the slot target. Because the slot target automatically decreases in size, both in length and width, the game becomes more difficult as the balls are trapped, and any ball projected up the surface which is not trapped in the slot target will roll back down into engagement with the front wall. Preferably, numbers will be provided along the length of the slot to assign points to the trapped balls for scoring.

In another embodiment, a slot ball game incorporates a pair of slot targets formed in the ball-rolling surface. Each of the slot targets transversely extend to the length of the surface and is adapted to trap a plurality of balls in the described manner. A ball ejector may be incorporated with the slot ball games for releasing the trapped balls whereby a lever operatively associated with the ball ejector is disposed adjacent the front end of the game for selectively engaging the ball ejector to force the balls upwardly out of the slot target to permit the balls to roll back to the launching end by gravity.

BRIEF DESCRIPTION OF THE DRAWINGS.

The aforementioned objects and advantages of the invention will be appreciated from the following description and accompanying drawings wherein.

DESCRIPTION OF THE PREFERRED EMBODIMENT.

Figure 1:
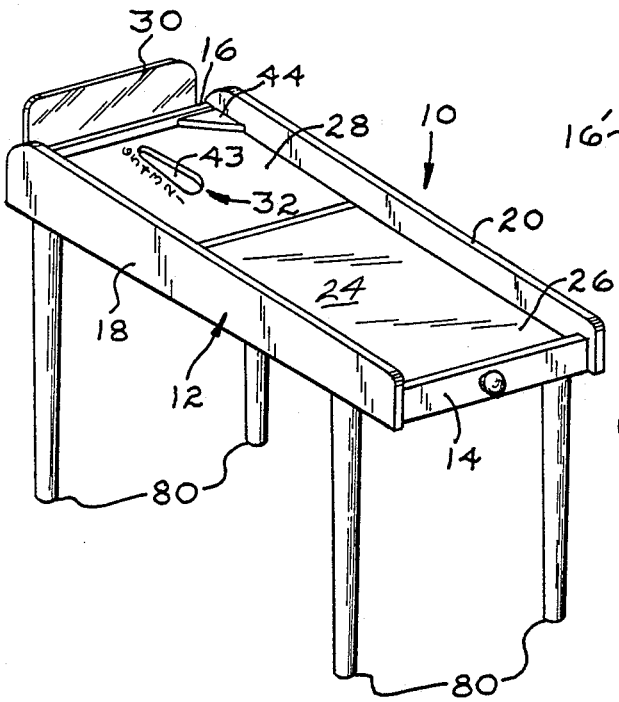
FIG. 1 is a perspective view of a slot ball game in accord with the inventive concepts.
Figure 2:
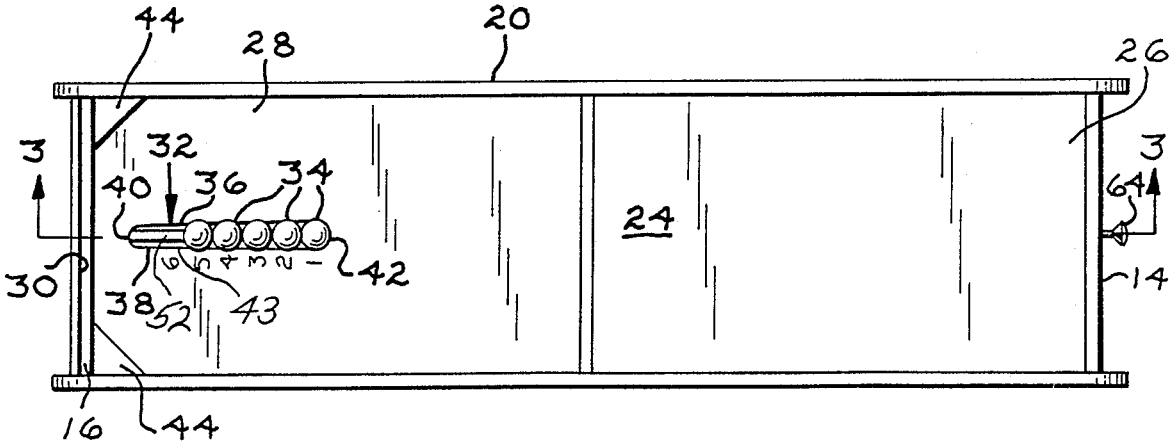
FIG. 2 is a top plan view of the game of FIG. 1.
Figure 3:
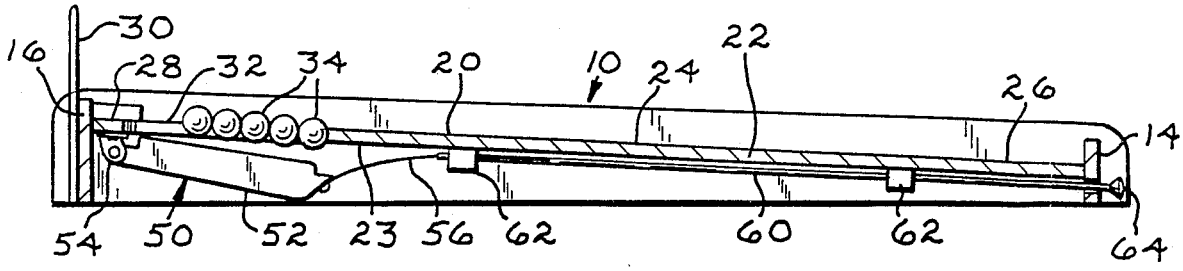
FIG. 3 is an elevational, cross-sectional view of the game as taken along Section 3—3 of FIG. 2.

In FIGS. 1-3 a slot ball game in accord with the invention is generally indicated at 10 and includes a frame 12 which is of an elongated configuration having a front wall 14, a back wall 16, and vertically extending lateral side walls 18 and 20. The frame 12 includes a flat playing board 22 having a lower side 23 and an upper side 24 disposed between the walls defining a ball-rolling surface. The surface 24 is slightly inclined, the lowermost portion adjacent the front wall 14 defining a ball launching end 26, and the uppermost portion is defined at 28 adjacent the back wall 16. Preferably, the ball-rolling surface 24 is covered with a felt or fabric material similar to that of a billiard table or the like, and a decorative mirror 30 may be mounted adjacent the back wall 16. An elongated slot opening 32 is formed in the portion 28 defining a target in accord with the inventive concepts.

The slot target 32 extends through the thickness of the board 22 and is adapted to receive and "trap" a plurality of spherical balls 34 rolled thereover, FIG. 2. The slot target 32 includes a pair of spaced edges 36 and 38 which intersect the surface 24 and define the width of the slot target 32. The edges 36 and 38 extend in a diverging relation with respect to one another from a back arcuate edge 40 to a front arcuate edge 42 to provide a decreasing width along the length of the slot target 32 from the front edge 42 to the back edge 40. The slot target 32 longitudinally extends the length of the board 22 whereby the edges 36, 38, 40, and 42 define an opening 43 of a given area intersecting the surface 24.

The overall width of the slot target 32 is less than the diameter of the balls 34. A ball 34 rolling across the surface 24 and over the opening 43 will fall into the slot target 32 such that the ball 34 rests on the edges 36 and 38 and a portion of the ball extends above the surface 24 while another portion of the ball extends into the depth of the slot target 32 to "trap" the ball therein. The length of the slot target 32 is sufficient to receive a plurality of balls 34 whereby, due to the inclination of the ball-rolling surface 24 and the slot divergence, the first ball trapped in the slot target 32 will roll into engagement with the front edge 42, and each subsequently trapped ball will roll into engagement with the previously trapped ball as illustrated in FIGS. 2 and 3.

Thus, as the balls 34 accumulate in the slot target 32 the exposed area 43 of the target slot for receiving another ball 34 automatically decreases in length and width due to the presence of the trapped balls. Since the slot target 32 is provided with a greater width adjacent the front edge 42 than at the back edge 40, each subsequently trapped ball will extend slightly further above the surface 24, less into the depth of the slot target 32, and the subsequently projected balls will have a narrower portion to roll over.

The balls 34 may be projected across the ball-rolling surface from the launching end 26 toward the slot target 32 either by hand or by striking the ball with a cue, not shown. Bumpers 44 may be mounted in the upper corners of the board 22 to bank the balls 34 toward the slot target 32, and the walls 16, 18 and 20 may also be used to bank the balls theretoward. The front wall 14 defines a stop to engage balls rolling back on the surface 24 which were not trapped in the slot target 32. Various values may be provided adjacent the length of the slot target 32 to assign points to the balls 34 as the balls accumulate therein for scoring purposes. As each ball 34 trapped in the slot target 32 reduces the exposed area of the slot target for trapping a subsequently projected ball, the game 10 automatically becomes more difficult for the player or players as the game progresses.

A ball ejector, generally indicated at 50, FIG. 3, includes an elongated ball lift 52 which is pivotally mounted at one end by a hinge 54 to the lower side 23. The opposite end of the ball lift 52 is connected to one end of a cable 56 adapted to pivot the lift 52 upwardly through the slot target 32 to engage the balls 34. The cable 56 extends to the front end of the game 10 through a outer cable or conduit 60, fastened to the board 22 by fasteners 62, and is connected to a push-pull handle 64 disposed adjacent the front wall 14.

Pulling the handle 64 outwardly from the front wall 14 pulls the cable 56 through the outer conduit 60 causing the ball lift 52 to pivot upwardly through the slot target 32 and forces the balls 34 upwardly out of the slot target 32 to permit the balls 34 to roll back to the launching end by gravity into engagement with the wall 14. Pushing the handle 64 inwardly pivots the ball lift 52 back to its original position, as shown. The ball ejector 50 permits a player to easily and conveniently release the trapped balls.

Figure 4:
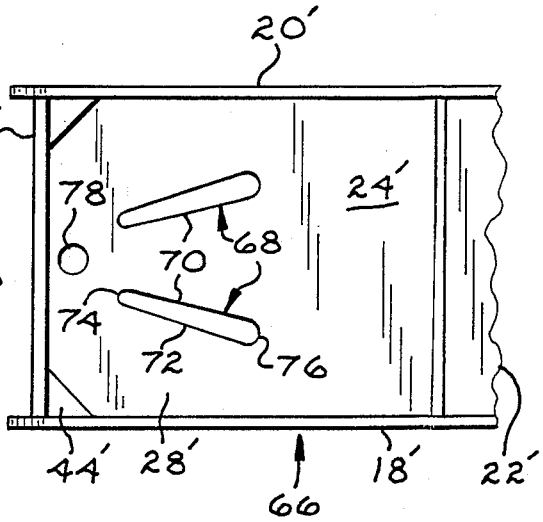
FIG. 4 is a top plan detail view of a slot ball game variation in accord with the invention incorporating a pair of slot targets.

In FIG. 4 another version of a slot ball game, as generally indicated at 66, is illustrated incorporating a pair of slot targets in accord with the inventive concepts. Components of the game 66 which are similar to components of the game 10 of FIGS. 1–3 are indicated by identical primed reference numerals.

The game 66 includes a playing board 22' having a ball-rolling surface 24' which extends from a ball launching end at the front of the game, not shown, to a back wall 16', and vertical side walls 18' and 20' laterally extend along the length of the surface 24'. The portion of the surface 24' as defined at 28' is provided with a pair of slot targets 68 having spaced non-parallel edges 70 and 72 extending from a back edge 74 to a front edge 76. The slots 68 define ball traps adapted to trap balls rolled thereover in the same manner as the slot target 32 of the game 10. However, unlike the slot target 32, the slot targets 68 extend obliquely to the length of the surface 24'. Bumpers 44' are mounted adjacent the back wall 16' adapted to bank the balls toward the slot targets 68'.

The game 66 also includes a recess 78 which is of sufficient shape and configuration to receive one of the balls projected thereover. The recess 78 may be marked with a number for scoring, or the recess may be used to designate a bonus or penalty. For instance, a player projecting a ball into the recess 78 may get a bonus shot or may be automatically eliminated from the game.

Various rules may be adopted to the play the games to generate player interest. As the size of the targets automatically decrease during the course of the game the degree of difficulty increases which provides a greater challenge for the players.

Preferably, the frames of the games 10, and 66 will be formed of high quality building material, such as wood, to provide a game of attractive appearance. Also, four attractive legs 80, FIG. 1, may be used to support the frames so that the games become self-standing furniture pieces located at a comfortable height.

It is not necessary that the targets extend through the thickness of the board, but rather a target may consist of a recess defined in the surface. It should also be noted that it is not necessary that the ball-rolling surfaces be inclined. However, an inclined ball-rolling surface facilitates automatic return of the balls not trapped in the target or targets for reuse.

It is appreciated that various modifications to the inventive concepts may be apparent to those skilled in the art without departing from the spirit and scope of the invention.

I claim:

1. A game comprising, in combination, a frame, a playing surface defined on said frame, and at least one target formed in said playing surface adapted to trap a plurality of game pieces projected thereover, said target defining an area adapted to receive and trap said game pieces and having means for retaining said trapped game pieces such that a portion of each of said game pieces remains in said target automatically decreasing the size of said target area as said game pieces are trapped.

2. A game comprising, in combination, a frame, a playing board defined on said frame having an upper side defining a ball-rolling surface, and at least one target formed in said playing board adapted to trap a plurality of balls rolled thereover, said target having an opening intersecting said ball-rolling surface defining an area adapted to receive said balls and having means for retaining said trapped balls such that a portion of each of said trapped balls remains in said opening automatically decreasing the size of said target area as said balls are trapped.

3. In a game as in claim 2, said target comprising an elongated slot formed in said playing board having a pair of spaced edges extending from a first end and terminating at a second end, said spaced edges defining the width of said opening, said first and second ends defining the length of said opening.

4. In a game as in claim 3, said balls having a diameter greater than the width of said slot, said retaining means comprising said spaced edges engaging said trapped balls such that a portion of said trapped balls extends above said ball-rolling surface while another portion extends below said ball-rolling surface.

5. In a game as in claim 4, wherein said ball-rolling surface extends on an incline with respect to the horizontal from a lowermost portion to an uppermost portion, said lowermost portion defining a ball launching end, said slot being formed in said uppermost portion.

6. In a game as in claim 5, said slot's first end being in a lower portion of said ball-rolling surface than said second slot end whereby the first one of said balls trapped in said slot rolls into engagement with said first end and each of said balls subsequently trapped therein rolls into engagement with said previously trapped ball due to gravity.

7. In a game as in claim 6, said spaced edges extending in a diverging relation with respect to one another from said second end to said first end providing a decreasing width along the length of said slot from said first end to said second end.

8. In a game as in claim 2, wherein said ball-rolling surface extends on an incline with respect to the horizontal from a lowermost portion to an uppermost portion, said lowermost portion defining a ball launching end, said target being formed in said uppermost portion, and said ball-rolling surface being disposed between a pair of vertical side walls extending from a front wall adjacent said ball launching end to a back wall adjacent said uppermost portion, said front wall defining a stop for retaining said balls.

9. In a game as in claim 8, ball ejecting means defined in said target adapted to selectively release said trapped balls to permit said balls to roll to said front wall, and operating means operatively associated with said ball ejecting means disposed adjacent said ball launching end for selectively engaging said ball ejecting means.

10. In a game as in claim 9, said ball ejecting means comprising a member passing upwardly through said target.

11. In a game as in claim 2, at least one bumper mounted on said ball-rolling surface adapted to bank said balls toward said target.

12. In a game as in claim 2, wherein at least two targets are formed in said ball-rolling surface.

* * * * *